United States Patent [19]

Rom

[11] Patent Number: 4,599,925

[45] Date of Patent: Jul. 15, 1986

[54] FIBERBOARD CUTTING SYSTEM

[75] Inventor: Rudolph A. Rom, Woodridge, Ill.

[73] Assignee: The Lockformer Company, Lisle, Ill.

[21] Appl. No.: 607,791

[22] Filed: May 7, 1984

[51] Int. Cl.[4] ..... D06H 7/00

[52] U.S. Cl. ..... 83/56; 83/455; 83/698; 83/925 CC

[58] Field of Search ..... 83/925 CC, 614, 56, 83/698, 881, 177, 171, 381, 455, 459, 464

[56] References Cited

U.S. PATENT DOCUMENTS

| | | | |
|---|---|---|---|
| 2,065,380 | 12/1936 | Lamson | 83/455 |
| 3,677,123 | 7/1972 | Gerber et al. | 83/658 |
| 3,797,340 | 3/1974 | Pereman | 83/886 |
| 3,967,519 | 7/1976 | Esterly | 83/455 |
| 4,088,049 | 5/1978 | Benedict | 83/614 |
| 4,382,728 | 5/1983 | Anderson et al. | 83/925 CC |
| 4,391,168 | 7/1983 | Gerber et al. | 83/925 CC |

*Primary Examiner*—James M. Meister
*Assistant Examiner*—John L. Knoble
*Attorney, Agent, or Firm*—McDougall, Hersh & Scott

[57] ABSTRACT

A system for cutting fiberboard wherein a table is provided for supporting the fiberboard with a cutter mounted above the table whereby the cutter is adapted to engage the insulation. The cutter is movable vertically for adjusting its position relative to the insulation and the mount for the cutter is provided with a drive whereby the cutter can be driven longitudinally and transversely of the table for cutting the fiberboard into various shapes. A hold-down device is associated with the cutter for movement therewith and for pressing against the insulation during the cutting operation to thereby prevent displacement of the insulation relative to the table. The cutter preferably comprises a cutting blade rotatably supported on a vertical shaft with the shaft and blade having freedom of movement during a cutting operation. The pointed end of the blade is offset from the axis of the blade supporting shaft which causes the blade to faithfully follow the desired path of movement in the course of the cutting operation. The table for supporting the insulation preferably includes a cutting board which is releasably held in place. The cutter and associated hold-down are also readily detached from the system so that the system can be quickly adapted for other uses.

26 Claims, 7 Drawing Figures

FIBERBOARD CUTTING SYSTEM

BACKGROUND OF THE INVENTION

This invention relates to a system for cutting insulation. Insulation can be employed for a variety of applications, and the insulation is usually formed into standard sizes which are then cut into different shapes depending upon the particular application for the insulation.

Glass fiber insulation is an example of a type of product requiring some system for cutting the product into a desired shape. In one particular application, the insulation is utilized for providing ducts for heating and cooling systems. In such systems, the insulating characteristics of the product provide advantages, and the product is also light-weight and, therefore, easily handled during installation. Furthermore, the insulation can be readily cut to provide different sizes and shapes.

Machines have been developed for cutting glass fiber product for example, as described in Gale, et al. U.S. Pat. No. 3,420,142 and Barr U.S. Pat. No. 3,605,534. The machines described in these patents generally involve the use of a frame employed for mounting one or more cutting blades. Drive rollers are mounted on the frame for engaging a section of insulation and the board is driven relative to the stationery blades for achieving the cutting action. In such systems, the cutting is limited to cutting along a line or lines parallel with the direction of movement of the board. If cutting transverse to such lines is desired, the board must be turned 90 degrees and then driven a second time through the machine.

Other types of cutting systems are known such as sheet metal cutting machines using plasma arc cutting means. In machines of this type, the plasma arc cutting tool is mounted on a transverse beam, and drive means associated with the beam operate to move the cutting tool transversely over a bed supporting the sheet metal. The beam is in turn mounted on supports which engage rails running longitudinally of the bed. Separate drive means achieve movement of the beam and associated tool in a longitudinal direction which provides maximum versatility for the tool. Thus, any combination of transverse and longitudinal positions of the tool can be accomplished whereby the tool can move along lines which are parallel to transverse and longitudinal axes as well as along lines between these axes. The cutting tool can, for example, be programed to cut around corners and to achieve curved cutting lines where desired.

SUMMARY OF THE INVENTION

The system of this invention generally involves an apparatus for cutting insulation wherein the insulation is mounted on a table with a cutter being mounted for movement over the table. Drive means for the cutter permit vertical adjustment to locate the cutter in proper position for penetrating the insulation during a cutting operation. Separate drive means associated with the cutter achieve longitudinal and transverse movement of the cutter relative to the table so that no limitations are placed on the cutting lines.

In accordance with one aspect of the invention, the cutter is mounted in a machine designed for sheet metal cutting operations. Thus, the cutter may be positioned on a beam extending transversely over a table with drive means being provided for moving the cutter along the beam. The beam may be, in turn, mounted on supports at the sides of the table with separate drive means being provided to achieve a longitudinal component of movement for the cutter.

Where a sheet metal cutting means is modified to provide an insulation cutting system, it is preferred that a cutting board designed for supporting insulation be first located on the table of the machine. This cutting board preferably includes means for resting the board on the table of the machine and means for automatically aligning the board relative to the table. It is preferred that the cutting board be held in position by gravity so that the board can be readily removed when one wishes to change the machine back to a sheet metal cutting operation.

Similarly, an assembly including the cutting blade is mounted in the sheet metal cutting machine in a fashion such that it can be very easily installed and removed. This also facilites utilization of the same basic machine for both sheet metal and insulation cutting operations.

The cutting operation preferably involves the use of hold-down means which are associated with the cutter and which move with the cutter during a cutting operation. These hold-down means, which may include rollers positioned on opposite sides of the cutter, are adapted to press against fiberboard positioned on the table. By pressing against the fiberboard, the hold-down means insure that the insulation is maintained in a steady position throughout a cutting operation.

The blade used for cutting in a system of the type described is preferably mounted on a shaft which is freely rotatable. In addition, the blade is positioned so that the end of the blade is located in a plane parallel to the axes of the blade-supporting shaft but offset from this axis. Finally, in the preferred method of operating the system, the end of the blade is positioned to penetrate somewhat beyond the extent of the insulation whereby the blade end actually penetrates into the cutting board of the system.

The result of the design and operating method described is that the blade will very faithfully follow a desired cutting line. In particular, where it is desired to provide a curved cutting line as when forming a corner, the blade, even though mounted on a freely rotatable shaft, will automatically maintain proper alignment to achieve a cutting line consistent with the transverse and longitudinal components of movement imparted by the respective drive means.

DETAILED DESCRIPTION OF THE INVENTION

Figure 1:
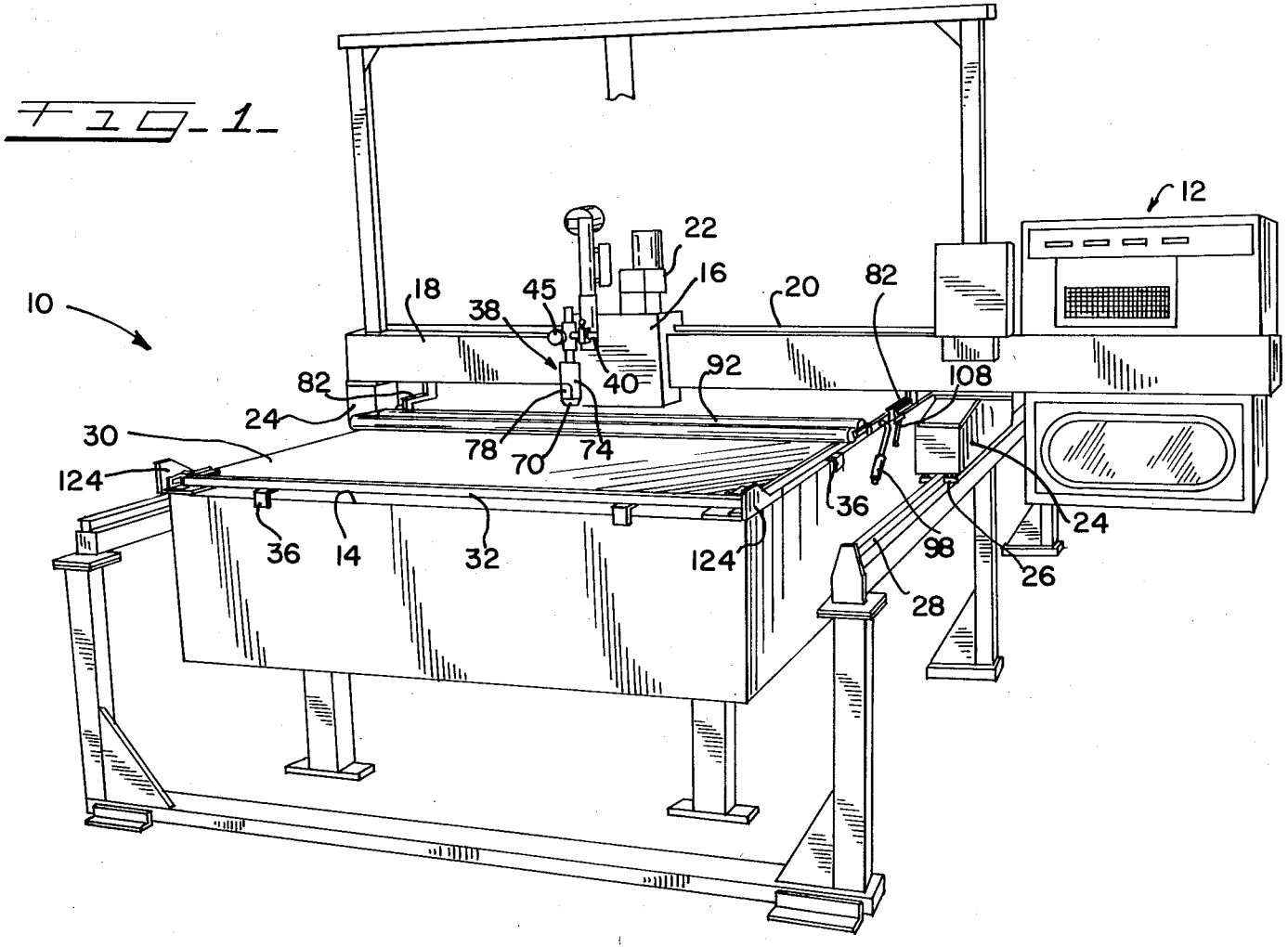
FIG. 1 is a perspective view of a cutting machine characterized by the features of this invention.
Figure 2:
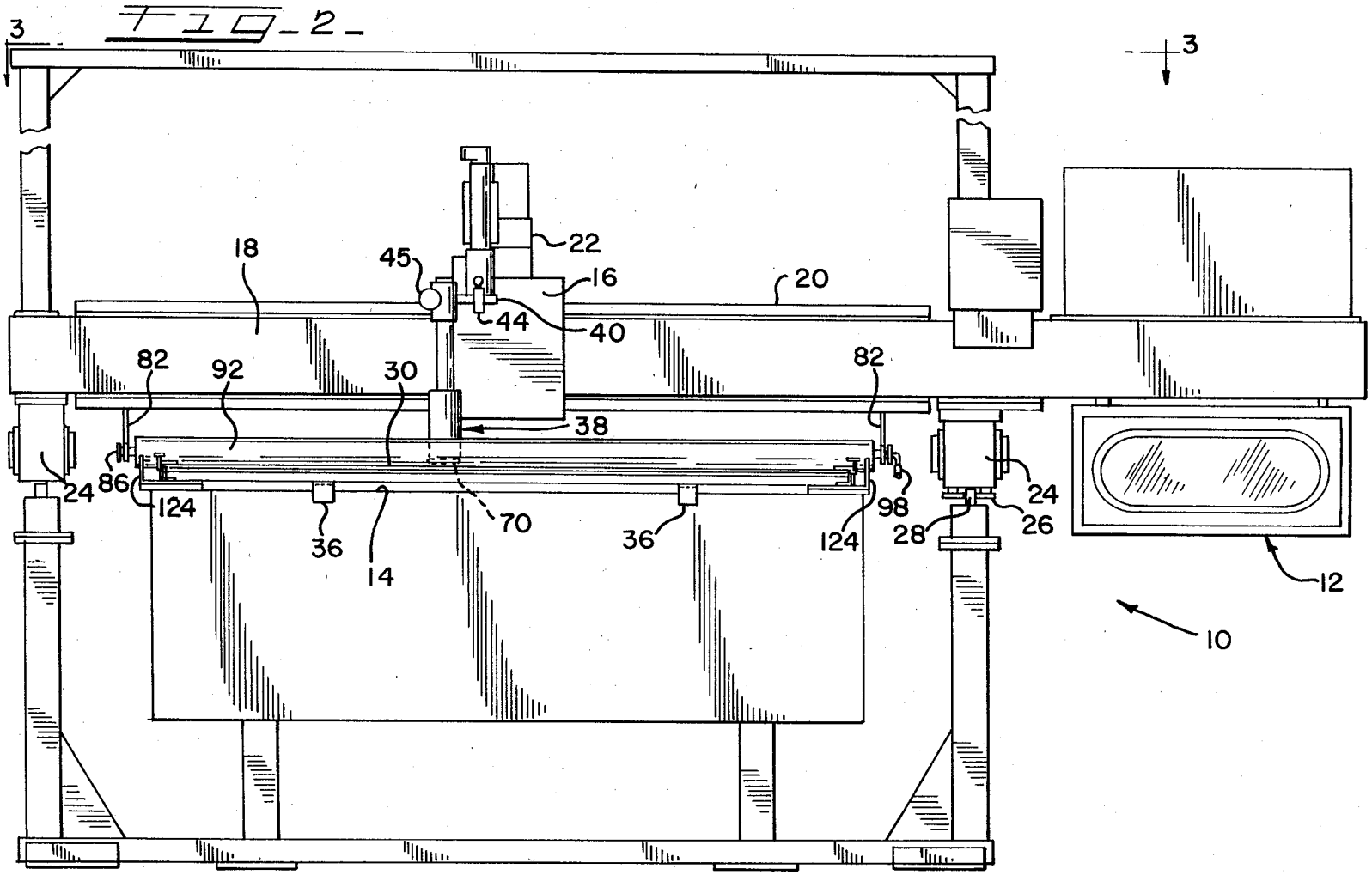
FIG. 2 is a front elevational view of the machine illustrated in FIG. 1.

The drawings illustrate a cutting machine 10 of the type designed for use in the cutting of sheet metal. A typical machine of this type, for example, the Vulcan 1200 manufactured by the Lockformer Company of Lisle, Ill., includes a control section 12 which provides for computer operation of the equipment. Specifically, the control section includes programing means so that a cutting device associated with the system will traverse a piece of sheet metal in order to achieve pieces cut from a metal sheet of particular shapes.

In the operation of such a machine, the metal sheet is located on a supporting bed 14, and a movable mount 16 is provided for carrying a plasma arc cutter. The mount 16 is located on a beam 18 which defines a rail 20, and a drive unit 22 is provided for moving the mount 16 along the rail 20. Any conventional drive means such as a gear drive, may be employed for this purpose.

The beam 18 is supported at its ends by a pair of carriers 24 with at least one carrier supporting drive wheels 26. A separte drive unit is provided for these carriers so that engagement of the wheels 26 with rail 28 will result in movement of the beam longitudinally over the bed 14. It will, therefore, be appreciated that the mount 16 for the cutting mechanism can be independently provided with both longitudinally and transverse components of movement so that cutting lines of various forms can be achieved. The cutting means can, for practical purposes, traverse the entire bed 14 and can be programmed to move from point-to-point along any desired path.

Figure 6:
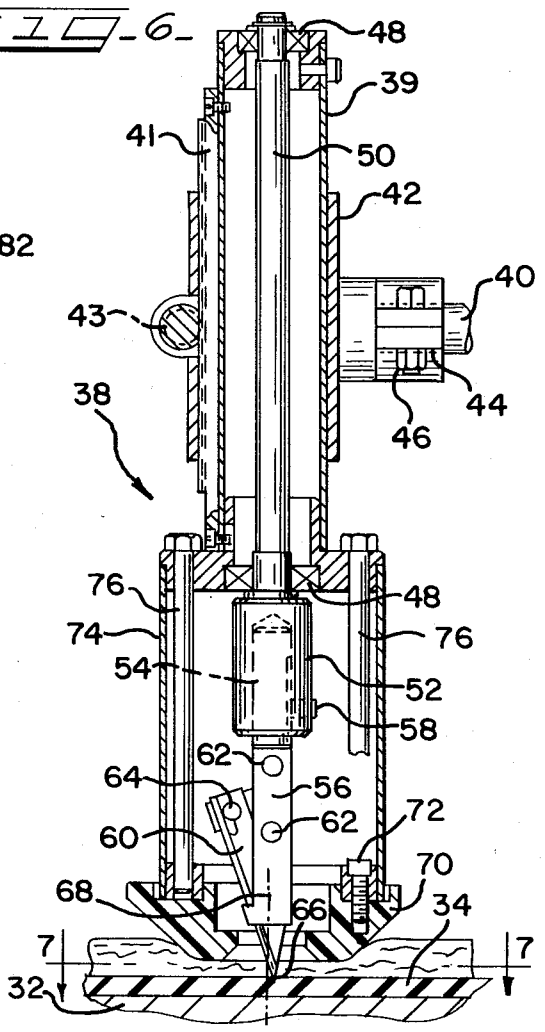
FIG. 6 is an enlarged fragmentary cross-sectional view of the cutter assembly taken about the line 6—6 of FIG. 3; and, FIG. 7 is a cross-sectional view taken about the line 7—7 of FIG. 6.

In accordance with this invention, a cutting board 30 is located on the bed 14. The board 30 as best shown in FIGS. 1 and 6 consists of a base 32 formed of hardwood, or some composite material such as wood and metal or wood and plastic whereby a reliable flat surface is provided. Thus, it is desirable to provide a base which will not warp over a period of time.

The surface of the cutting board 30 comprises a natural or synthetic rubber-like material 34. As will be more specifically discussed, this material is of a composition which can be penetrated by a cutting blade, and either this covering or the entire cutting board may be replaced from time-to-time.

The cutting board is designed to rest on the bed 14 without any need for latching means or the like. Angle members 36 are attached to the board to serve as convenient aligning means when the board is located on the bed 14.

A cutter assembly 38 of the type shown in detail in FIG. 6 is adapted to be associated with the mount 16 whereby the assembly will move the mount along the beam 18, and with the beam when the beam is driven longitudinally of the bed 14. The cutter assembly includes a rod 40 which extends outwardly from a sleeve 42 and a clamp 44 is emplolyed for securing the rod to mount 16. It will be appreciated that the bolt 46 associated with the clamp can be readily loosened for purposes of separating the cutter assembly from the mount. In the same fashion, a plasma arc cutter or other device may be readily interchanged with the cutter assembly 38. It will also be understood that other means may be employed for securing the cutting mechanism to the mount 16.

The cutter assembly 38 includes bearings 48 which receive shaft 50. The shaft 50 carries a chuck 52 which receives the end 54 of blade support 56. A set screw 58 is provided for securing the blade support within the chuck.

A cutting blade 60 is attached to the support 56 in a conventional fashion, for example by means of fasteners 62 which clamp the blade within the support. Also in a conventional fashion, a fastener 64 may be employed for adjustably holding the blade relative to the support.

The blade defines a pointed end 66 which is offset relative to the axis 68 of the shaft 50. Thus, a line parallel to the axis 68 and extending through end 66 will be spaced from a plane which includes the axis 68. In a typical system, the offset between the end of the blade and the axis of the shaft will be from about 1/16th to about ½ of one inch.

The cutter assembly 38 also includes a collar 70 which is preferably made from a smooth, wear-resistance material such as Teflon. One or more screws 72 may be utilized for securing the collar in place so that the collar will be positioned in surrounding relationship relative to the blade.

A tubular shield 74 is also included in the assembly 38, and bolts 76 are utilized for holding the shield in assembly with collar 70. As best shown in FIG. 1, the shield 74 may define an opening 78 to permit access to the blade 60 so that the blade can be replaced or adjusted as desired.

Figure 3:
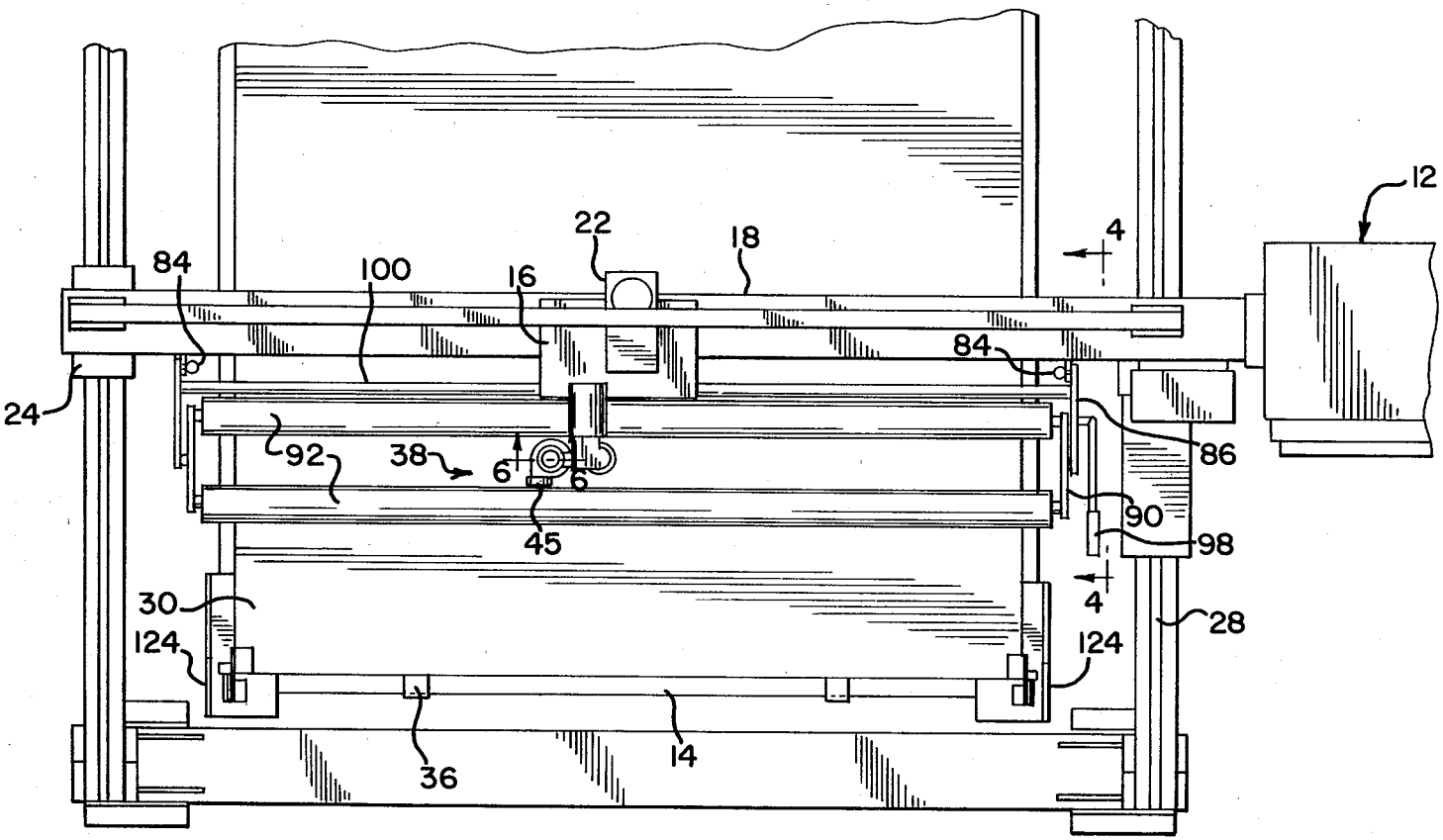
FIG. 3 is a fragmentary plan view of the machine taken abut the line 3—3 of FIG. 2.

The upper portion of the assembly 38 includes a tubular housing 39 which carries a rack 41. Pinion 43 is provided for engaging the rack, and a knob 45 (FIGS. 1 and 3) is employed for rotating the pinion to thereby move the housing 39 relative to sleeve 42. Fine vertical adjustment of the cutting assembly can thus be achieved and, as indicated, other vertical adjustments can be achieved by means of drive means normally associated with the illustrated equipment.

Figure 4:
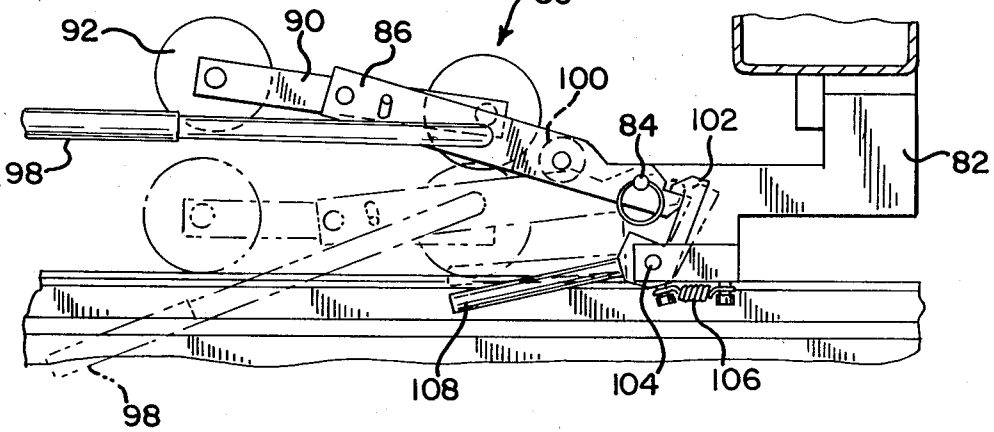
FIG. 4 is an enlarged fragmentary cross-sectional view taken about the line 4—4 of FIG. 3.
Figure 5:
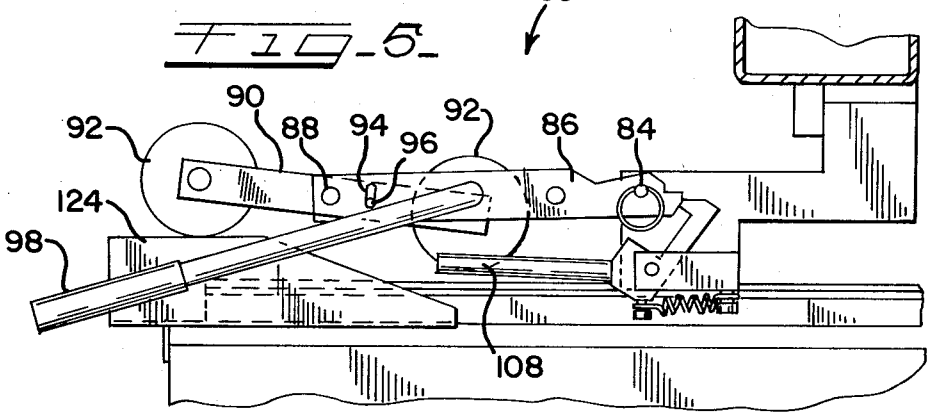
FIG. 5 is an enlarged fragmentary cross-sectional view illustrating the hold-down structure of FIG. 4 at the end of the supporting bed of the machine.

A hold-down assembly 80 as best illustrated in FIGS. 4 and 5 is utilized in the system. This assembly includes a pair of brackets 82 which are attached to the transversely extending beam 18. Each of the brackets defines an opening for receiving a pin 84, and each of these pins serves to secure a support arm 86 to the bracket. The pins 84 preferably comprise a quick-release type, for example with a spring-loaded button, so that the pins can be quickly removed for separating the arms 86 from the brackets 82. In the embodiment of the invention illustrated, the brackets 82 become a permanent part of the machine.

The arms 86 are pivotally attached at 88 to arms 90 which support hold-down rollers 92. A slot 94 is defined by the arms 86, and a pin 96 carried by arms 90 is received within this slot. This arrangement limits the degree of pivoting movement permitted between the arms 86 and 90.

A handle 98 is attached to an arm 86 at one side of the machine as shown in FIG. 1. This handle permits pivoting movement of the arms 86 around pins 84 with a tie rod 100 being employed to transmit the pivoting movement from one side of the machine to the other.

FIG. 4 illustrates the upper position of the arm 86 and associated rollers in solid lines with the lower position of this assembly being shown in phantom.

The upper position of the assembly is employed to permit access to the table of the machine, for example when locating insulation in place for a cutting operation or when removing pieces that have been cut. In order to simplify this action, a latch 102 is pivotally connected at 104 to the bracket 82 on the side of the machine shown in FIG. 1. A spring 106 normally urges this latch in a counterclockwise direction so that the latch will retain the arms 86 and rollers 92 in the solid line position of FIG. 4. A handle 108 is associated with the latch which permits pivoting of the latch clockwise to the phantom position of FIG. 4 to thereby permit the assembly to be lowered to the phantom position of FIG. 4. When the handle 98 is employed fo raising this assembly back to the solid line position, the latch will automatically re-engage under the urging of spring 106.

In describing the operation of the illustrated equipment, it will be assumed that the cutting board 30, hold-down assembly 80, and cutting assembly 38 are in position on the machine. The cutting operation commences by locating the holddown assembly in the solid line position of FIG. 4, and then placing a piece of insulation to be cut in position beneath this assembly. The respective drive means of the equipment are employed for moving the cutting assembly and hold-down assembly to a desired starting position, and the blade 60 is then driven downwardly into the insulation.

As shown in FIG. 6, the collar 70 of the cutting assembly is adapted to penetrate into the insulation which, in the usual case, will be a more or less flexible material. The collar will remain at this elevation throughout the cutting operation to thereby serve as a stabilizing means.

Before the cutting operation begins, the hold-down assembly 80 is lowered to operating position as shown in FIG. 4. This is accomplished by grasping handle 98 and then releasing latch 102 by means of handle 108. By holding handle 98, the operator can lower the hold-down rollers into operating position without damaging the insulation. The hold-down rollers are preferably of stainless steel or are othewise of sufficiently heavy material so that they will press firmly against the insulation. These rollers, therefore serve to hold the insulation firmly against he underlying cutting board so that displacement of the insulation relative to the cutting board will not take place.

The cutting operation is accomplished by operating the respective drive means in the system. Thus, the drive means 22 for the mount 16 will impart a transverse component of movement to the cutting blade. The drive means for rollers 26 provide a longitudinal component of movement and simultaneous operation of these drive means will impart a variety of cutting directions depending upon the particular operation desired. In this connection, the system is readily suited for operation in response to a computer program which will efficiently control operation of the respective drive means.

Figure 7:
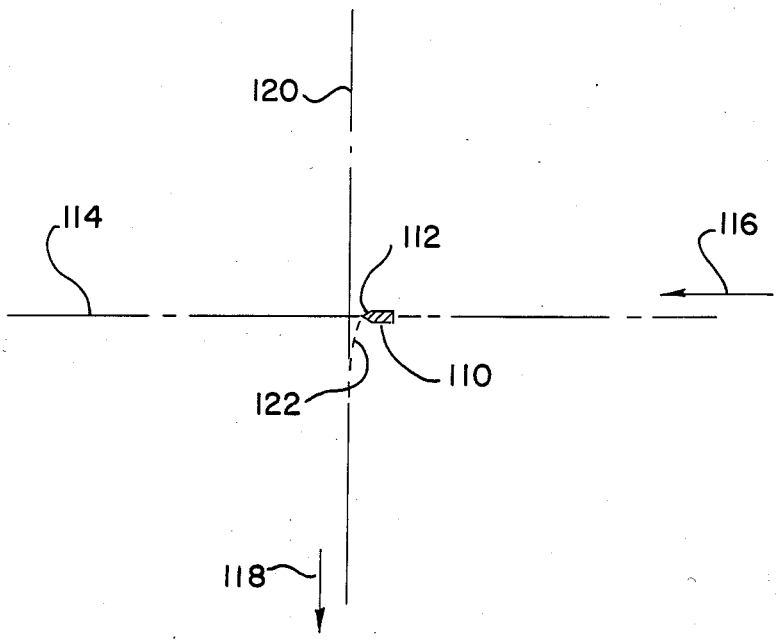

FIG. 7 illustrates the lower end 110 of the cutting blade. This blade defines a leading end 112 which achieves the cutting operation and the diagram of FIG. 7 is intended to illustrate cutting along a line 114 while the cutting assembly 38 is moving in the direction of the arrow 116. The line 114 coincides with the line followed by the axis of blade supporting shaft 50.

When one wishes to change the direction of cutting movement, for example, in the direction of arrow 118, the drive means are operated so that the direction of the axis of the shaft 50 is abruptly changed from movement along line 114 to movement along line 120. When this abrupt change is made at the intersection of the lines 114 and 120, the leading edge 112 of the blade 60 will follow line 122 until it begins movement along line 120. This is accomplished due to the offset of the end of the blade relative to the axis of the supporting shaft 50. Thus, the change of direction of movement of that axis from the line 114 to the line 120 automatically causes the cutting action to shift from the one line to the other. It is for this reason that the shaft supporting the blade 60 is freely rotatable in the cutting assembly. The specific line along which the blade will cut is thus controlled solely by the direction of movement of the cutting assembly 38. It is believed that this is accomplished due to the fact that the point of the blade is offset from the axis of the blade supporting shaft with the portion 110 of the blade tending to serve like a rudder for consistently maintaining the cutting edge in the desired path of movement. As part of this action, it is preferred that the lower end 66 of the blade be maintained at an elevation such that it will penetrate the surface of the rubber-like material 34 of the cutting board. By insuring this penetration, the "rudder" action imparted by the cutting blade will always tend to maintain the leading edge of the blade in a plane which also includes the axis of the blade supporting shaft.

Another feature of the invention involves the provision of cams 124 positioned at the end of the cutting board 30. The cams are provided for engaging the end roll 92 when this roll approaches the end of the table. By providing this engaging surface for the end roll, any tendency for the roll to drop downwardly off the end of the table when the cutting assembly reaches an extreme position is avoided. In addition, the soft insulation tends to curl up when the cutter reaches the end of the pad. The cams keep the outer roller elevated so that it comes down on top of the insulation when moving back away from the table end instead of grabbing the the end of the pad. It will be noted that the cams 124 are associated with the cutting board 30 so that these cams are removed with the cutting board whenever the machine is to be reconverted to a plasma arc cutting system or the like.

The reconversion to another cutting system also involves the simple step of disconnecting the hold-down assembly 80 by removing the pins 84. The only other steps involved are the removal of the cutting assembly by loosening the bolt 46 and the replacement of this assembly with a plasma arc cutting tool or some similar mechanism. Applicant's arrangement thus provides a very economical means of achieving a insulation cutting system since existing sheet metal cutting equipment may be employed with only a few additional parts added.

Following are examples of operations conducted with the system of this invention:

| Insulation Material | Offset | Blade Projection | Pad Height | Blade Angle & Number | Cutting Speed |
|---|---|---|---|---|---|
| Certain Teed Ultra-lite Duct Liner Fiber-glass 200 ½ Thick | 3/16 | 1/4–9/32 | 5/32 | 45° Stanley #11-040 Sheepfoot Style | 250 in/mi |
| Owens-Corning Fiberglas Aeroflex Cust Liner Type 200 ½" Thick 2 lb. | 3/16 | 9/32 | 5/32 | 45° Stanley #11-040 Sheepfoot Style | 250 in/mi |
| Owens-Corning 1" Thick 1½ | 3/16 | 5/16 | 13/64 (203) | 45° Stanley #11-040 Sheepfoot | 250 in/mi |

-continued

| Insulation Material | Offset | Blade Projection | Pad Height | Blade Angle & Number | Cutting Speed |
|---|---|---|---|---|---|
| lb | | | | Style | |
| Johns-Manville Lina-coustic fiber glass duct liner ½" 2 lb. | 3/16 | 5/16 | 3/16 | 45° Stanley #11-040 Sheepfoot Style | 250 in/mi |

The "blade projection" is the distance the blade end projects beyond the bottom surface of collar 70, and the "pad height" is the thickness of the insulation being cut.

It will be understood that various changes and modifications may be made in the above-described system which provide the characteristics of this invention without departing from the spirit thereof particularly as defined in the following claims.

I claim:

1. An apparatus for cutting insulation comprising a table for supporting the insulation, a cutter, mounting means for the cutter to hold the cutter above the table whereby the cutter is adapted to engage insulation supported on the table, vertical adjustment means for the cutter for locating the cutter in position to penetrate the insulation, drive means for said mounting means whereby the cutter can be driven longitudinally and transversely of the table for cutting the insulation into various shapes, and hold-down means pressing against the insulation during the cutting to thereby prevent displacement of the insulation relative to said table, said cutter comprising a cutting blade of the type defining a leading cutting edge portion, a narrow body portion trailing said cutting edge portion, and a lower end, a vertical shaft supporting said blade, and means rotatably supporting said shaft whereby the shaft and blade have unrestrained freedom of movement during a cutting operation, said table including a supporting surface adapted to be penetrated by said end during the cutting operation, and wherein a plane parallel to the axis of said vertical shaft and including said end is offset relative to said axis.

2. An apparatus in accordance with claim 1 wherein the distance between said end and said axis is from about 1/32 to about ½ of one inch.

3. An apparatus in accordance with claim 1 including a collar surrounding said blade, said collar being positioned for pressing against said insulation during the cutting operation.

4. An apparatus in accordance with claim 1 including means for releasably attaching said cutter to its mounting means.

5. An apparatus in accordance with claim 1 wherein said table comprises a frame, and a cutting board removably supported on said frame, said insulation being supported on said cutting board.

6. An apparatus in accordance with claim 1 including means for releasably mounting said hold-down means on said mounting means.

7. An apparatus in accordance with claim 1 wherein said hold down means includes a pair of rollers, one roller being positioned on each side of said cutter.

8. In an apparatus for cutting insulation comprising a table for supporting the insulation, a cutter comprising a cutting blade, mounting means for the cutter to hold the cutter above the table whereby the cutter is adapted to engage insulation supported on the table, and drive means for said mounting means whereby the cutter can be driven longitudinally and transversely of the table for cutting the insulation into various shapes, the improvement comprising a vertical shaft supporting said blade, said blade being of the type defining a leading cutting edge portion, a narrow body portion trailing said cutting edge, and a lower end, and means rotatably supporting said shaft whereby the shaft and blade have unrestrained freedom of movement during a cutting operation, said table including a supporting surface adapted to be penetrated by said end during the cutting operation, and wherein a line parallel to the axis of said vertical shaft and extending through said end is offset relative to said axis.

9. An apparatus in accordance with claim 8 wherein the distance between said end and said axis is from about 1/32 to about ½ of one inch.

10. An apparatus in accordance with claim 8 including a collar surrounding said blade, said collar being positioned for pressing against said insulation during the cutting operation.

11. An apparatus in accordance with claim 8 including means for releasably attaching said cutter to its mounting means.

12. In an apparatus for cutting insulation comprising a table for supporting the insulation, a cutter, mounting means for the cutter to hold the cutter above the table whereby the cutter is adapted to engage insulation supported on the table, and drive means for said mounting means whereby the cutter can be driven longitudinally and transversely of the table for cutting the insulation into various shapes, the improvement wherein said table comprises a frame, and a cutting board removably retained on said frame for supporting insulation, said cutting board including a compressible surface whereby said cutter is adapted to penetrate the surface during the cutting operation, said cutter comprising a cutting blade, a vertical shaft supporting said blade, and means rotatably supporting said shaft whereby the shaft and blade have unrestrained freedom of movement during a cutting operation, said blade defining a leading cutting edge portion, a narrow body portion trailing said cutting edge, and a lower end adapted to penetrate said surface during the cutting operation.

13. An apparatus in accordance with claim 12 wherein a line parallel to the axis of said vertical shaft and extending through said end is offset relative to said axis.

14. An aparatus in accordance with claim 13 wherein the distance between said end and said axis is from about 1/32nd to about ½ of one inch.

15. A method for cutting insulation comprising the steps of supporting the insulation on a table, providing a cutter comprising a cutting blade, providing a collar for said blade, mounting the cutter and associated collar on means holding the cutter above the table whereby the cutter is adapted to engage insulation supported on the table, driving the cutter longitudinally and transversely of the table for cutting the insulation into various shapes, and rotatably supporting said blade whereby the blade has unrestrained freedom of movement during a cutting operation, said blade defining a leading cutting edge portion, a narrow body portion trailing said cutting edge, and a lower end, and wherein a line parallel to the axis of said vertical shaft and extending through said end is offset relative to said axis, and including the step of locating said end whereby said end penetrates the surface of said table during the cutting operation, said collar surrounding said blade, and including the step of pressing said collar against said insulation during the cutting operation whereby said collar penetrates into the insulation and stabilizes said cutter as the cutter moves during a cutting operation.

16. A method in accordance with claim 15 wherein the distance between said end and said axis is from about 1/32 to about ½ of one inch.

17. An apparatus for cutting insulation comprising a table for supporting the insulation, a cutter, mounting means for the cutter to hold the cutter above the table whereby the cutter is adapted to engage insulation supported on the table, vertical adjustment means for the cutter for locating the cutter in position to penetrate the insulation, drive means for said mounting means whereby the cutter can be driven longitudinally and transversely of the table for cutting the insulation into various shapes, and hold-down means mounted on said mounting means for movement with the cutter, said hold-down means pressing against the insulation during the cutting to thereby prevent displacement of the insulation relative to said table, said hold-down means including at least one roller, said roller extending transversely across said table and adjacent said cutter, and including cam means positioned at the side of said table adjacent the end of the table, said cam means engaging said roller to lift the roller out of contact with said insulation when the cutter approaches said end of the table.

18. An apparatus in accordance with claim 17 wherein a pair of rollers are provided, and connecting means extending between the ends of the respective rollers to hold the rollers in assembly.

19. An apparatus in accordance with claim 18 wherein said connecting means include outer arms rotatably supporting the ends of one roll, and inner arms pivotally connected to each outer arm, said inner arms rotatably supporting the ends of the other roll, and including latch means associated with at least one arm for latching the assembly of rolls and arms in a position spaced from said table to permit location of insulation on said table, and removal of insulation from said table.

20. In an apparatus for cutting insulation comprising a table for supporting the insulation, a cutter, mounting means for the cutter to hold the cutter above the table whereby the cutter is adapted to engage insulation supported on the table, and drive means for said mounting means whereby the cutter can be driven longitudinally and transversely of the table for cutting the insulation into various shapes, the improvement comprising the hold-down means mounted on said mounting means for movement with the cutter, said hold-down means pressing against the insulation during the cutting to thereby prevent displacement of the insulation relative to said table, said hold-down means including at least one roller, said roller extending transversely across said table and adjacent said cutter, and including cam means positioned at the side of said table adjacent the end of the table, said cam means engaging said roller to lift the roller out of contact with said insulation when the cutter approaches said end of the table.

21. An apparatus in accordance with claim 20 including a collar surrounding said cutter, said collar being positioned for pressing against said insulation during the cutting operation.

22. An apparatus in accordance with claim 20 including means for releasably mounting said hold-down means on said mounting means.

23. An apparatus in accordance with claim 20 wherein a pair of rollers are provided, one roller being positioned on each side of said cutter.

24. An apparatus in accordance with claim 20 wherein a pair of rollers are provided, and connecting means extending between the ends of the respective rollers to hold the rollers in assembly.

25. An apparatus in accordance with claim 24 wherein said connecting means include outer arms rotatably supporting the ends of one roll, and inner arms pivotally connected to each outer arm, said inner arms rotatably suppporting the ends of the other roll, and including latch means associated with at least one arm for latching the assembly of rolls and arms in a position spaced from said table to permit location of insulation on said table, and removal of insulation from said table.

26. An apparatus for cutting insulation comprising a table for supporting the insulation, a cutter, mounting means for the cutter to hold the cutter above the table whereby the cutter is adapted to engage insulation supported on the table, vertical adjustment means for the cutter for locating the cutter in position to penetrate the insulation, drive means for said mounting means whereby the cutter can be driven longitudinally and transversely of the table for cutting the insulation into various shapes, and means holding the insulation during the cutting to thereby prevent displacement of the insulation relative to said table, said cutter comprising a cutting blade of the type defining a leading cutting edge portion, a narrow body portion trailing said cutting edge portion, and a lower end, a vertical shaft supporting said blade, and means rotatably supporting said shaft whereby the shaft and blade have unrestraind freedom of movement during a cutting operation, said table including a supporting surface adapted to be engaged by said end during the cutting operation, and wherein a plane parallel to the axis of said vertical shaft and including said end is offset relative to said axis.

* * * * *